United States Patent [19]

Schuster

[11] 3,940,914

[45] Mar. 2, 1976

[54] FALSE TWISTER

[75] Inventor: Friedrich Schuster, Hammelburg, Germany

[73] Assignee: Kugelfischer Georg Schafer & Co., Schweinfurt, Germany

[22] Filed: Jan. 3, 1975

[21] Appl. No.: 538,410

[30] Foreign Application Priority Data

Jan. 4, 1974 Germany ..... 2400240

[52] U.S. Cl. ..... 57/77.4

[51] Int. Cl.[2] ..... D02G 1/08

[58] Field of Search ..... 57/77.3–77.4

[56] References Cited

UNITED STATES PATENTS 3,813,868 6/1974 Lorenz ..... 57/77.4

3,872,661 3/1975 Eaves ..... 57/77.4

FOREIGN PATENTS OR APPLICATIONS 490,534 6/1970 Switzerland ..... 57/77.4

*Primary Examiner*—Donald E. Watkins

*Attorney, Agent, or Firm*—Stevens, Davis, Miller & Mosher

[57] ABSTRACT

An apparatus for false twisting a thread having three rotatably mounted spindles each carrying a pluralilty of friction discs which overlap each other and means for passing a thread along a zig-zag path between the spindles and over the edges of the friction discs is provided with at least one friction disc having a twist stop edge which interrupts the helical path of the thread in a kink-like manner at the exit end of the path of the thread.

9 Claims, 6 Drawing Figures

FALSE TWISTER

This invention relates generally to apparatus for false twisting threads and more particularly to a false twister provided with improved friction discs.

False twist devices having friction discs for friction false twisting of synthetic threads or crimping them are known in various forms. A particularly advantageous false twister has three rotatably mounted mutually parallel spindles, each carrying at least one friction disc and lying in plan view at the corners of an equilateral triangle. The discs on each spindle overlap the discs on the other spindles so that the thread to be false twisted passes between the discs along a zig-zag path. The three spindles are driven so that they all rotate in the same direction. False twister devices of this type are disclosed in German OS No. 2,213,147 and in the corresponding U.S. Patent application Ser. No. 342,085 filed Mar. 16, 1973, the disclosure of which is incorporated herein by reference.

It has also been proposed, in such a false twister, to curve or bow in cross-section the symmetrical convex contact surfaces or peripheral edges by which the friction discs engage the thread, so that the thread passes through the device substantially along a helical path. In such an arrangement, the aim is that the friction discs each comprise, at the contact surface with the thread, at least two materials having respectively a higher co-efficient of friction for imparting the false twist and having a lower co-efficient of friction for guiding the thread on the disc, advantageously the material of higher friction co-efficient being present at that point of the contact surface which has the greatest peripheral speed. The material having the higher co-efficient of friction can furthermore be sandwiched at the contact surface on both sides between material of lower co-efficient of friction as disclosed in German Patent Application No. P 23 06 853.3, and the corresponding U.S. patent application Ser. No. 441,209 filed Feb. 8, 1974, the disclosure of which is incorporated herein by reference.

In such friction discs the imparting of the false twist occurs only on a part of the overall breadth of the contact surface, so that also in the case of a convexly bowed contact surface, which is particularly favorable, the region of it which imparts the false twist rotates at substantially the same peripheral speed over all parts of it. This not only achieves trouble-free uniformly good and satisfactory imparting of the false twist but also significantly reduces the danger of thread breakage.

It is an object of the present invention to provide false twist apparatus of the kind described in which a defined twist stop point is given, so that the extent of the twist remains constant. Another object of the invention is to provide a false twist device for crimping threads having friction discs provided with peripheral edges having a twist stop point whereby the extent of the twist of the thread is constant.

Other objects will become apparent from the following description with reference to the accompanying drawing wherein FIG. 1 is a partially longitudinally sectioned side view of a first embodiment of the invention;

Figure 1:
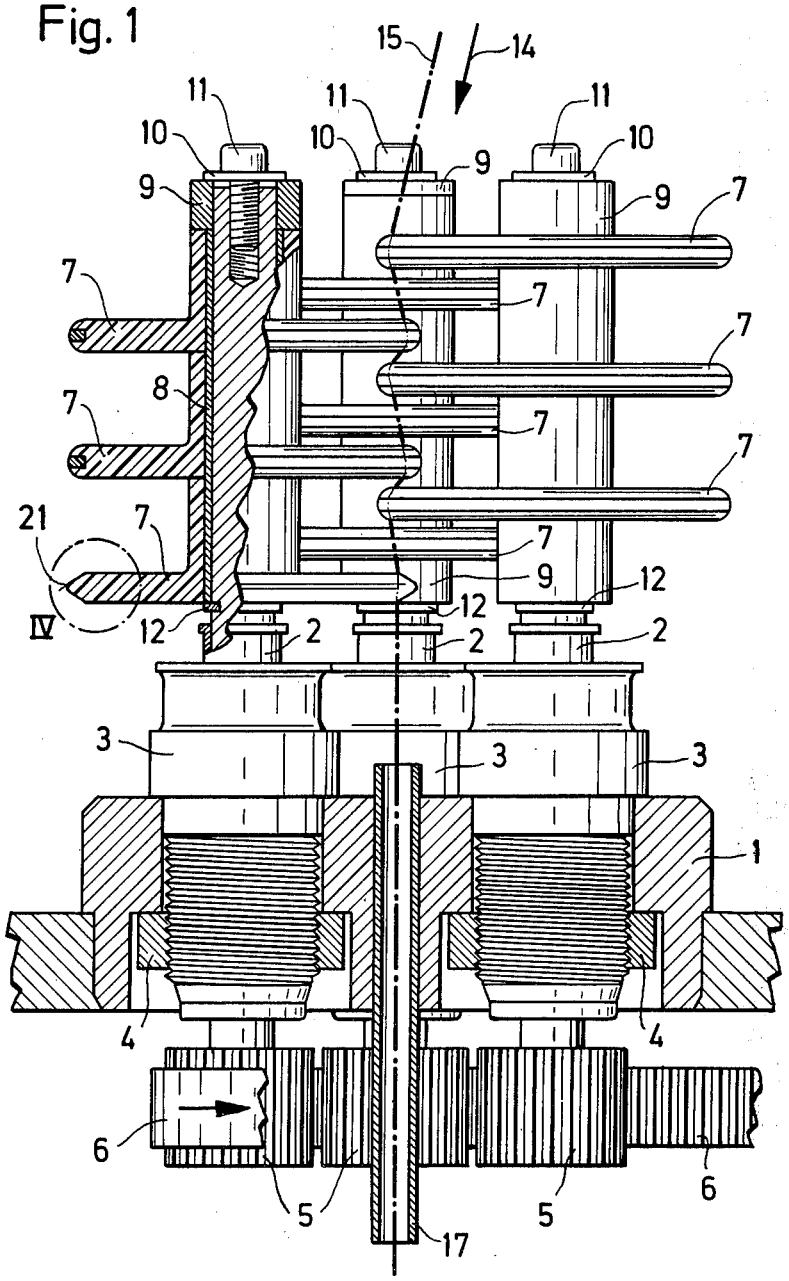

The foregoing objects and others are accomplished in accordance with this invention by providing a false twist apparatus having a friction disc provided with a twist stopping edge which interrupts the helical path of the thread passing through the apparatus at a predetermined point on the thread exit side where the thread experiences a somewhat sharp kink.

Some embodiments of the apparatus according to the invention are described in the following by way of example with reference to the drawing.

Figure 2:
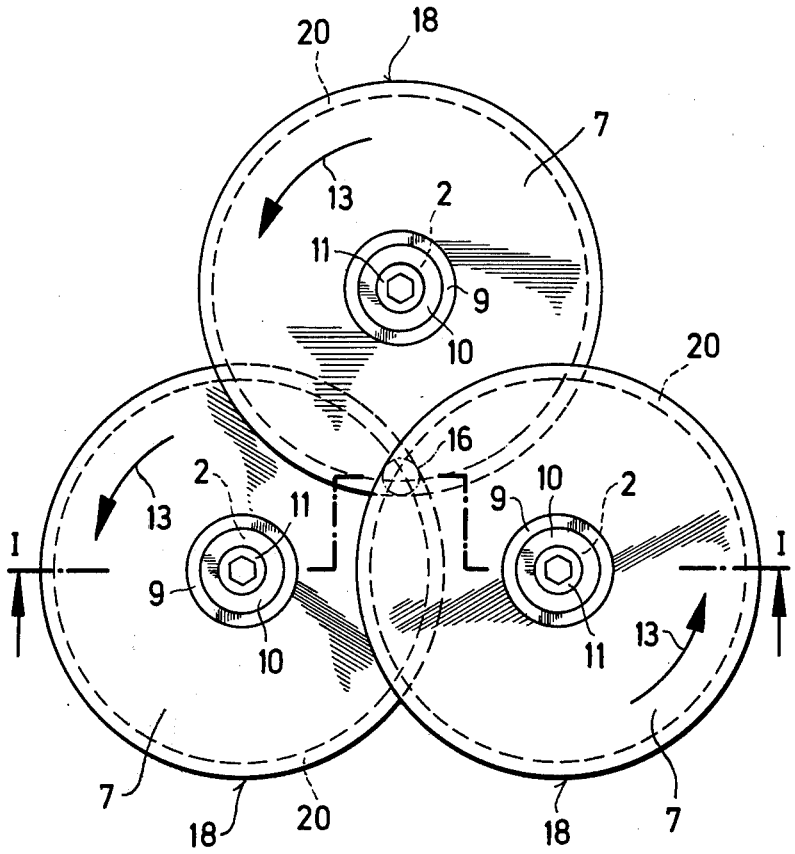
FIG. 2 is a plan view of the embodiment of the apparatus of FIG. 1.

The false twister shown in FIG. 1 comprises a base plate 1 carrying three spindles 2. These spindles are arranged with their longitudinal axes parallel to each other and in plan view lie at the corners of a triangle, as seen in FIG. 2. Each spindle 2 is provided with a sealed bearing 3 which is secured to the base plate 1 by means of a nut 4. Furthermore, at its lower end as viewed in FIG. 1 each spindle 2 is provided with an externally toothed wheel 5. All three wheels 5 are enclosed by a common internally toothed belt 6. Accordingly, the spindles 2 all run in the same direction of rotation when in operation.

On each spindle 2 there is mounted a set of three friction discs 7, each having a hub and an annular flange at one end of the hub. The friction discs 7 of each set are assembled next to one another on a common locating sleeve 8. The locating sleeve 8 is fitted onto the associated spindle 2 together with a spacer ring 9 and secured to the spindle to rotate with it by means of a screw 11 with a washer 10. At the end of it furthest from the washer 10 and the screw 11 the locating sleeve 8 engages an abutment ring 12 provided on the spindle 2.

The sets of friction discs, which are mutually identical apart from the twist stopping edge, to be described later, are arranged on the respective associated spindle 2 with the friction discs 7 in different axial positions. This is achieved by the spacer rings 9. On the left hand spindle 2 as viewed in FIG. 1 such a spacer ring 9 is placed above the set of discs, and the same is true of the right hand spindle 2, in which, however, the set of friction discs is the other way round, i.e. they are standing on their heads. On the central spindle 2 there are two spacer rings 9, namely a taller one at the bottom and a thinner one above the set of discs, which itself is arranged the same way up as the discs on the left hand spindle 2.

The discs 7 therefore overlap one another and in operation they rotate in the same direction, for example in the direction of the arrow 13 in FIG. 2. The thread 15 which passes through the apparatus in the direction of the arrow 14, that is to say in a downward direction, is therefore provided with a Z twist. As it passes through the apparatus it follows a helical path of substantially uniform pitch, i.e. it runs on a path which follows a helix about an imaginary cylinder 16 indicated in broken lines in FIG. 2, to pass out of the apparatus through a fixed tubular balloon-preventer 17. The balloon-preventer 17 extends through the base plate 1 and is secured to it at the center of the above-mentioned triangle of spindles.

The thread 15 is pressed against peripheral edge of each disc 7; in fact against a contact surface 18 on each disc, so as to roll on it. The contact surface 18 is split into regions of different co-efficients of friction, which are mutually adjacent one another in the direction of the thickness of the disc and which extend around the whole of the periphery of the disc. For this purpose, in the disc 7 made from material of low co-efficient of friction, there is machined an annular groove 19 in which is provided a ring 20 of material of higher co-efficient of friction. The region of higher co-efficient of friction of the contact surface 18, formed by the ring 20, serves to impart the false twist, and the two adjacent regions of lower co-efficient of friction serve to guide the thread on the disc 7. In the region of higher co-efficient of friction the peripheral speed of the contact surface 18 is substantially uniform, so that exact imparting of the false twist is achieved.

Figure 3:
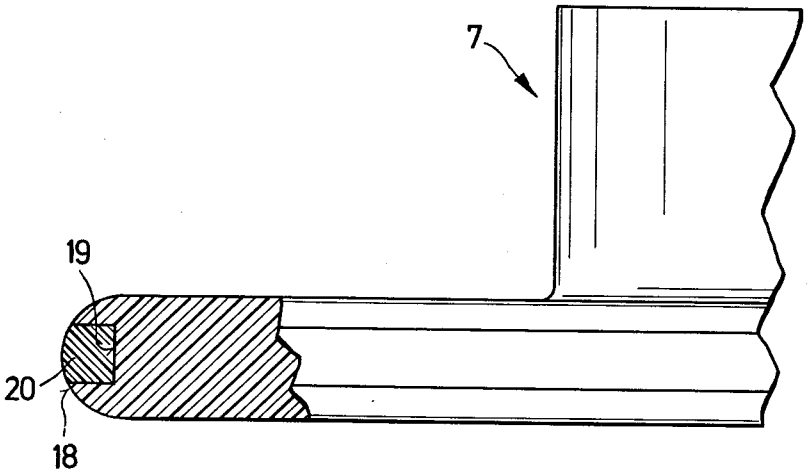
FIG. 3 shows part of an enlarged partially longitudinally sectioned side view of a friction disc which has no twist stop edge, in the apparatus of FIGS. 1 and 2.

As shown particularly clearly in FIG. 3, the contact surface 18 has a symmetrical convex cross-sectional shape. Also the ring 20 lies symmetrically with respect to this contact surface 18, i.e. in its central region.

Figure 4:
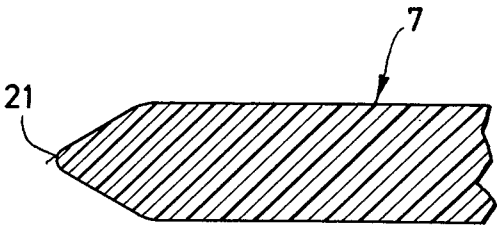
FIG. 4 is an enlarged view within the circle at IV in FIG. 1.

According to the invention a rotating twist stop edge is provided, interrupting the helical path of the thread 15 at the thread exit face, and in fact in FIG. 1 this is provided on the lowermost disc 7. This disc 7 has at its periphery a sharp cross-section, the rounded-off tip of the cross-section forming the twist stop edge 21, as shown particularly clearly by FIG. 4. From this it will be seen that in the disc 7 which has the twist stopping edge 21 there is no ring corresponding to the ring 20.

Figure 5:
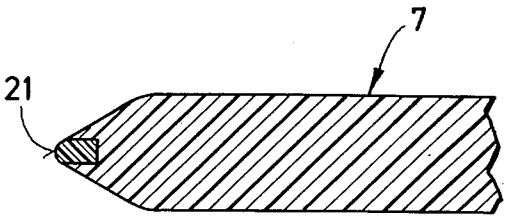
FIGS. 5 and 6 are each views corresponding to FIG. 4 and showing respectively a second and third embodiment of the friction disc with the twist stop edge.

However, as shown in FIG. 5, the twist stopping edge 21 can have a high co-efficient of friction with respect to the thread to be false twisted. The embodiment in FIG. 5 differs from that of FIG. 4 solely in that a ring 22 made from a material of high co-efficient of friction similar to that of insert 20 of FIG. 3 is provided in an annular groove 23 in the disc 7. As in the embodiment of FIG. 4 the cross-section at the periphery of the disc 7 is of symmetrical form, although it is true that the groove 23 and the ring 22 are asymmetrical, i.e. they are arranged off-set towards the thread exit face.

Figure 6:
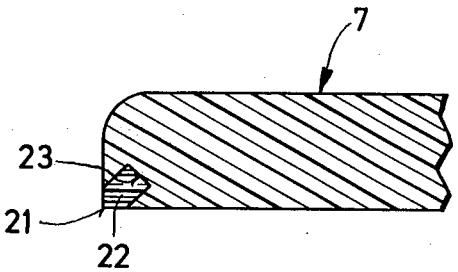

The embodiment of the twist stop edge 21 shown in FIG. 6 differs from that of FIG. 5 only in that the disc 7 having this twist stopping edge 21 has an asymmetrical cross-section at its periphery.

Although the invention is described in detail for the purpose of illustration it is to be understood that such detail is solely for that purpose and that variations can be made therein by those skilled in the art without departing from the spirit and scope of the invention except as it may be limited by the claims.

What is claimed is:

1. In an apparatus for false-twisting threads by means of friction discs which comprises three rotatably mounted mutually parallel spindles, each provided with at least one friction disc, the disc or discs on each spindle overlapping the discs on the other two spindles, and means for passing the thread to be false-twisted over the discs along a substantially helical path, the improvement which comprises providing one of the friction discs with a rotating twist stop edge disposed to interrupt the helical path of the thread in a kink-like manner on the exit face.

2. The apparatus of claim 1 wherein the twist stop edge is provided on only one of the friction discs.

3. The apparatus of claim 2 wherein the friction disc having the twist stop edge has at its periphery a sharp cross-section.

4. The apparatus of claim 3 wherein the friction disc having the twist stopping edge has an asymmetrical cross-section at its periphery.

5. The apparatus of claim 1 wherein the twist stopping edge has a high co-efficient of friction with respect to the thread to be false-twisted.

6. The apparatus of claim 5 wherein the friction disc having the twist stopping edge is provided with a ring of material of high co-efficient of friction.

7. The apparatus of claim 1 wherein the friction discs which are free from twist stop edges each have at their contact surfaces with the thread to be false-twisted portions of at least two materials having respectively a higher co-efficient of friction for imparting the false twist and a lower co-efficient of friction for guiding the thread on the disc, the contact surfaces having a convex cross-sectional shape.

8. The apparatus of claim 7 wherein the material with the higher co-efficient of friction at the contact surface is sandwiched on both sides between material of lower co-efficient of friction.

9. In an apparatus for false-twisting a thread having three rotatably mounted spindles each carrying a plurality of friction discs which overlap each other and means for passing a thread along a zig-zag path between the spindles and over the edges of the friction discs, the improvement wherein the friction disc immediately adjacent to the point of exit of the thread from between the friction discs has a sharp peripheral edge over which the thread moves as it emerges from its zig-zag path whereby a substantially uniformly constant false twist is imparted to the thread.

* * * * *